US008112918B1

(12) United States Patent
Crowell et al.

(10) Patent No.: US 8,112,918 B1
(45) Date of Patent: Feb. 14, 2012

(54) FOLDABLE DISPLAY SYSTEM

(75) Inventors: Christopher S. Crowell, Lyme, CT (US); Joseph R. Klim, New Britain, CT (US)

(73) Assignee: Dimensional Communications, Inc., Chester, CT (US)

( * ) Notice: Subject to any disclaimer, the term of this patent is extended or adjusted under 35 U.S.C. 154(b) by 210 days.

(21) Appl. No.: 12/587,053

(22) Filed: Sep. 30, 2009

Related U.S. Application Data

(60) Provisional application No. 61/195,083, filed on Oct. 3, 2008.

(51) Int. Cl.
*G09F 1/00* (2006.01)

(52) U.S. Cl. ..... 40/124.14; 40/358; 40/107; D19/23

(58) Field of Classification Search ..... 40/124.14, 40/358, 107; D19/23; 229/122.21, 4.5
See application file for complete search history.

(56) References Cited

U.S. PATENT DOCUMENTS

| | | | | | |
|---|---|---|---|---|---|
| 1,246,385 | A * | 11/1917 | Bimeler | ..... | 40/358 |
| 3,059,361 | A * | 10/1962 | Sieve | ..... | 40/107 |
| 3,468,048 | A * | 9/1969 | Smith | ..... | 40/107 |
| 3,731,415 | A * | 5/1973 | Shore | ..... | 40/358 |
| 6,322,107 | B1 * | 11/2001 | Lieberman | ..... | 283/2 |

* cited by examiner

*Primary Examiner* — Gary Hoge

(57) ABSTRACT

In the present invention, a plurality of panel members are supportingly retained in a first holding plate, with each of the panel members being arcuately pivotable relative to the holding plate. In addition, a second, movable plate is cooperatively associated with the panel members for being longitudinally movable along the length of the panel members while securely retaining and being cooperatively associated with each panel member. In this way, the second, movable plate is quickly advanced from a first position in direct association or engagement with the first holding plate into a second position wherein the second, movable plate is extended away from the first holding plate substantially the full length of each panel member. When in this second position, each panel member is fixed in a locked and fully erect position.

17 Claims, 13 Drawing Sheets

FOLDABLE DISPLAY SYSTEM

RELATED APPLICATION

This application is claims the benefit of U.S. Provisional Patent Application Ser. No. 61/195,083, filed Oct. 3, 2008 entitled FOLDABLE DISPLAY SYSTEM.

TECHNICAL FIELD

This invention relates to advertising or promotional products and, more particularly, to advertising or promotional products, packaging and displays which are quickly and easily transformed between a substantially flat, two-dimensional construction and a fully erect, three-dimensional construction.

BACKGROUND ART

With the ever increasing quantity of products and services being offered to consumers, substantial interest has been given to promotional display systems for advertising products and services. In this regard, a wide variety of advertising displays and promotional literature has been created and distributed to consumers. However, due to the deluge of material to which average consumers are constantly exposed, greater emphasis has been placed upon developing eye-catching, visual displays and promotional material which will receive consumer attention.

Although various promotional or advertising products and printed displays have been created in an attempt to satisfy this demand, these prior art products have failed to provide the desired interest in generating results with production costs which advertisers are capable of justifying. In an attempt to generate a unique advertising or promotional display, some prior art products have employed complex folding systems which produced a three-dimensional display when unfolded or opened. However, in spite of the unique visual appearance and generated by such products, the overall cost of production and complexity of assembly of the systems have prevented such prior art systems from becoming popular.

Other prior art displays have attempted to generate consumer interest by providing unique visual images or other indicia as an integral part of the display. However, these prior art systems have also failed to generate the interest being sought, largely due to an inability to physically involve the consumer in the promotion or display.

In addition, other products, such as a greeting cards, have attempted to generate consumer interest. However, consumer involvement in the card display has not been achieved.

Furthermore, consumers as well as advertisers have long sought to obtain a unique promotional or advertising display system which the consumer can employ on a regular basis for providing a particular function or purpose which can be repeatedly employed. In this regard, advertisers have long sought to be able to provide consumers with a promotional or advertising display system which will be continuously used by a consumer with the product also containing promotional or advertising indicia printed thereon. In this way, consumer satisfaction with the product is achieved while the advertiser is able to obtain continuous display of the advertising indicia.

Therefore, it is a principal object of the present invention to provide an advertising or promotional display product which is quickly and easily trans-formed between a substantially flat, two-dimensional configuration and a fully erect three-dimensional configuration which provides the user with a multipurpose product that can be continuously and repeatedly employed.

Another object of the present invention is to provide an advertising/promotional display product having the characteristic features described above, which incorporates a plurality of exposed panels on which advertising indicia can be prominently displayed.

Another object to the present invention is to provide an advertising/promotional display product having the characteristic features described above, which is capable of being produced at a reasonable cost and provides an exciting, interest generating display and/or holding member.

Another object of the present invention is to provide an advertising/promotional display product having the characteristic features described above, which enables the consumer to physically control the presentation of the display in a unique, hands-on manner.

Another object of the present invention is to provide an advertising/promotional display product having the characteristic features described above, which is capable of mass production and assembly.

A further object of the present invention is to provide an advertising/promotional display product having the characteristic features described above, which provides a unique, eye-catching, exciting, and surprising display which is produced in response to action taken by the consumer.

Another object of the present invention is to provide an advertising/promotional display product having the characteristic features described above, which the consumer is able to adapt for personal use in a wide variety of alternate purposes.

Other and more specific objects will in part be obvious and will in part appear hereinafter.

SUMMARY OF THE INVENTION

By employing the present invention, all of the difficulties and inabilities of the prior art are eliminated and a unique, hands-on, visually exciting and interest generating advertising/promotional display product and/or holding system is realized. This desirable result is attained in the present invention by providing a unique multi-panel construction which is quickly and easily transformed between a substantially flat two-dimensional configuration and a fully erect and fully constructed three-dimensional configuration. In addition, the multi-panel construction is transformed into a housing member having any desired indicia, graphics, and the like printed on the panels thereof, with the housing member being employable for wide variety of consumer oriented functions or purposes.

In accordance with the present invention, a plurality of panel members are supportingly retained in a first holding plate, ring or collar with each of the panel members being arcuately pivotable relative to the holding plate. In addition, a second, movable plate, ring or collar is cooperatively associated with the panel members for being longitudinally movable along the length of the panel members while securely retaining and being cooperatively associated with each panel member.

In this way, the second, movable plate is quickly and easily advanced from a first position wherein the second, movable plate is positioned in direct association or engagement with the first holding plate into a second position wherein the second, movable plate is extended away from the first holding plate longitudinally moved substantially the full length of each panel member. When in this second position, each panel member is fixed in a locked and fully erect position, secured in that position by cooperative association with the first holding plate and the second, movable plate.

When positioned in its second, fully erect display configuration, the advertising/promotional display product of the present invention is maintained in the particular structural configuration specifically designed, with a size and shape for achieving a particular purpose or function. In this regard, the fully erect advertising/promotional display product may range from a three panel or three sided, triangular shape to a multi-panel, multi-sided product having any desired number of panels.

In addition, the resulting product can be open on one or more of its opposed ends and can range from a small, desk top structure to a large diameter container constructed for receiving candy, gifts, prizes, tools, clothing, laundry, trash, etc. In this regard, the promotional display product can be constructed for rapid assembly followed by the filling of the display product with a gift, candy, or the like. Preferably, in this embodiment, the first holding plate incorporates a movable section for providing easy access to the interior of the display product. Regardless of the resulting configuration, number of panels, and/or overall dimensions employed, the same structural arrangement is employed for quickly transforming the advertising/promotional packaging or display product from a two-dimensional configuration into a three-dimensional product useable for the desired purpose.

In order to achieve a rapid, and easily constructed transformation from a two-dimensional configuration into a three-dimensional configuration, the first holding plate and second movable plate are initially placed in cooperating association with each other, preferably in overlying contact with each other. When in this position, the plurality of panel members are arcuately pivotable relative to the first holding plate and the second movable plate, enabling each panel member to be pivoted into overlying relationship with each other, thereby providing a flat, compact, substantially two-dimensional folded configuration.

In addition, in the preferred construction, each panel member is mounted in locked engagement with the first holding plate, with each panel member being positioned in a separate, independent, elongated slot formed in the first holding plate. Furthermore, the second, movable plate incorporates a plurality of slots formed therein with one panel member mounted in each slot. In this way, the second, movable plate is longitudinally movable along the length of each panel member by simultaneously advancing second, movable plate along the length of each associated panel member.

Finally, in the preferred construction, one or more panel members incorporate an outwardly extending locking flange formed at the base thereof, for contacting the second, movable plate whenever the second, movable plate has been extended substantially the entire length of each panel member. In this way, the longitudinal movability of the second, movable plate is controlled while also assuring its cooperative association and secure interlocked engagement with each panel member thereof. Furthermore, additional movable plates may be employed, if desired, in order to add additional strength and rigidity to the final structure.

In addition to providing an advertising/promotional display product having virtually any desired size and shape, the present invention also provides a product on which numerous panels are employed, with each panel being available for incorporating any visual display desired by the sponsor. As a result, the advertising/promotional display product of the present invention enables a sponsor to create a highly desirable, functional and easily employed product for numerous users or recipients, with each product incorporating any desired indicia, message, alphanumeric designation, colors, logos, and the like, in order to entertain and/or inform the consumer.

Furthermore, if desired, the panel may be formed from any desired materials, including transparent material. In such constructions, any desired display must be included inside the panels for being viewable through the panel.

The invention accordingly comprises an article of manufacture, possessing the features, properties, and relation of elements which will be exemplified in the article hereinafter described, and the scope of the invention will be indicated in the claims.

THE DRAWINGS

For a fuller understanding of the nature and objects of the invention, reference should be had to the following detailed description taken in connection with the accompanying drawings, in which.

DETAILED DISCLOSURE

By referring to FIGS. 1-13, along with the following detailed discussion, the preferred constructions and operation of a plurality of alternate embodiments of the advertising and/or promotional display product of the present invention can best be understood. In each of these embodiments, alternate constructions and configurations of the multi-panel display product of the present invention are fully depicted and discussed in detail herein.

Although this disclosure and the associated drawings fully detail several alternate preferred embodiments of the present invention, further alternate embodiments and constructions can be implemented without departing from the scope of this invention. Consequently, it is to be understood that the following disclosure is provided for exemplary purposes only and is not intended as a limitation of the present invention, with all alternate embodiments which are evident from this disclosure being encompassed within the scope of the present invention.

Figure 1:
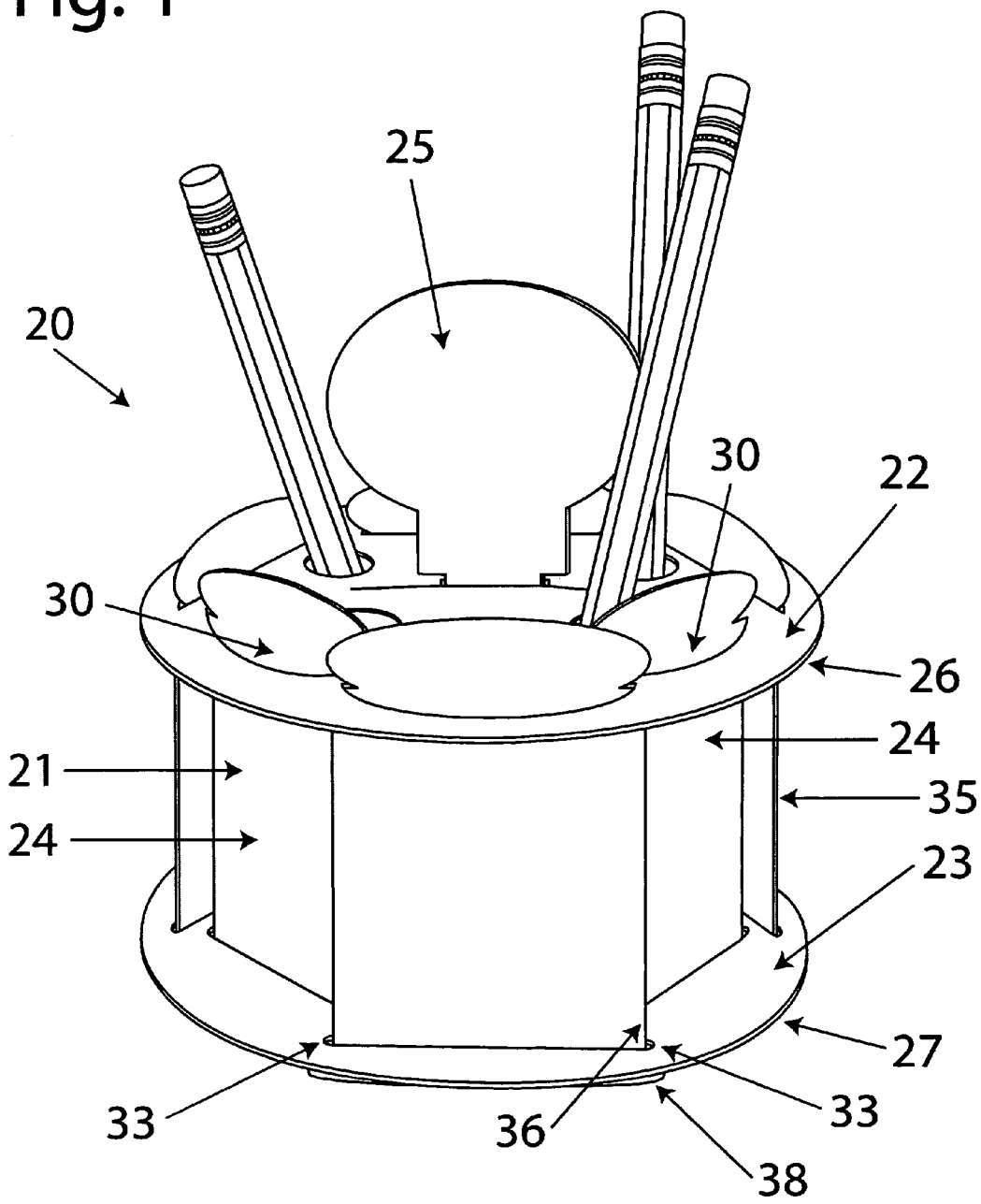
FIG. 1 is a perspective view of a multi-sided, advertising/promotional display product made in accordance with the present invention and shown in its fully assembled three-dimensional configuration and depicted as a combined calendar and pencil holder.
Figure 2:
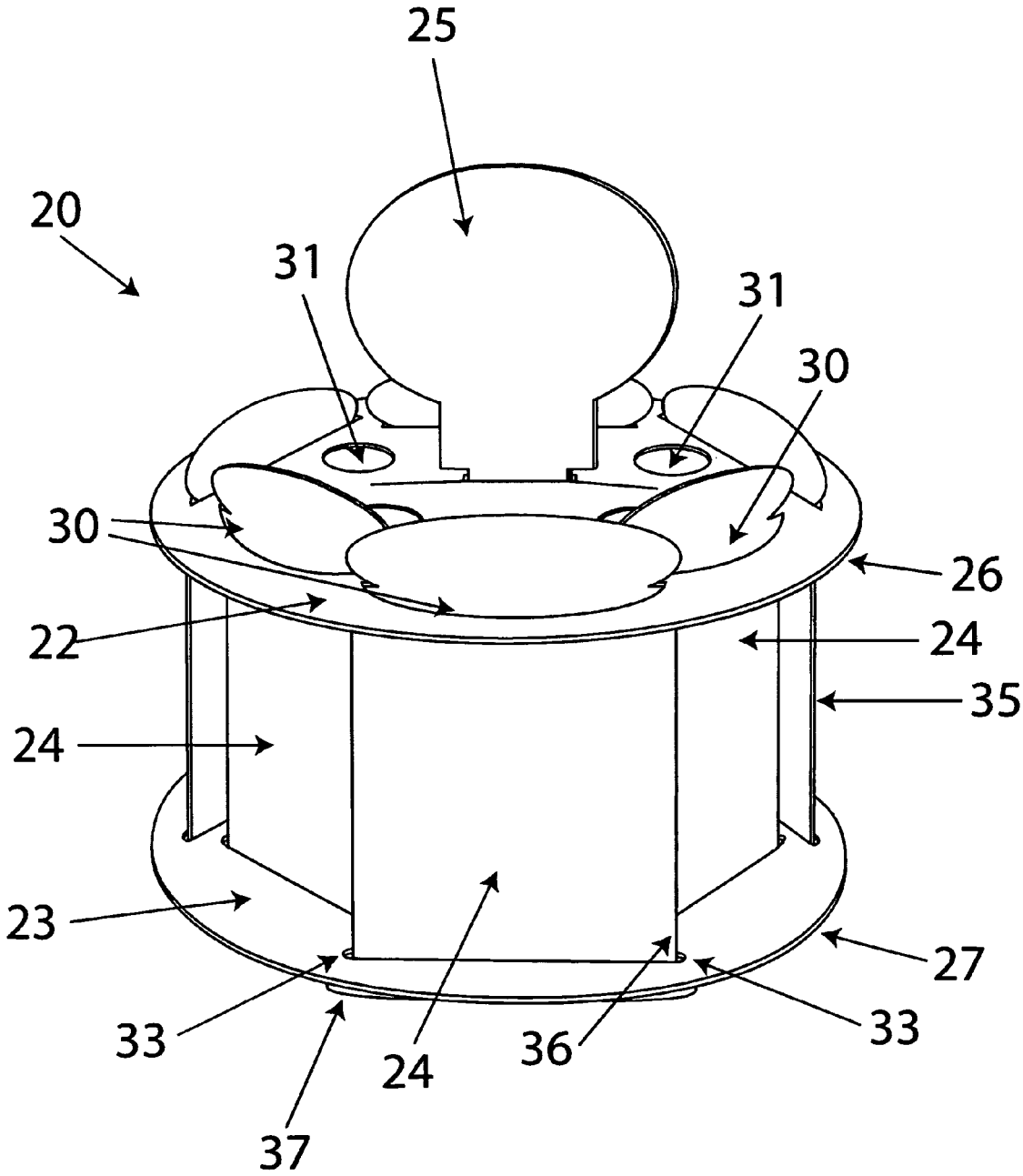
FIG. 2 is a perspective view of the multi-sided advertising/promotional display product of FIG. 1 with the pencils removed.
Figure 3:
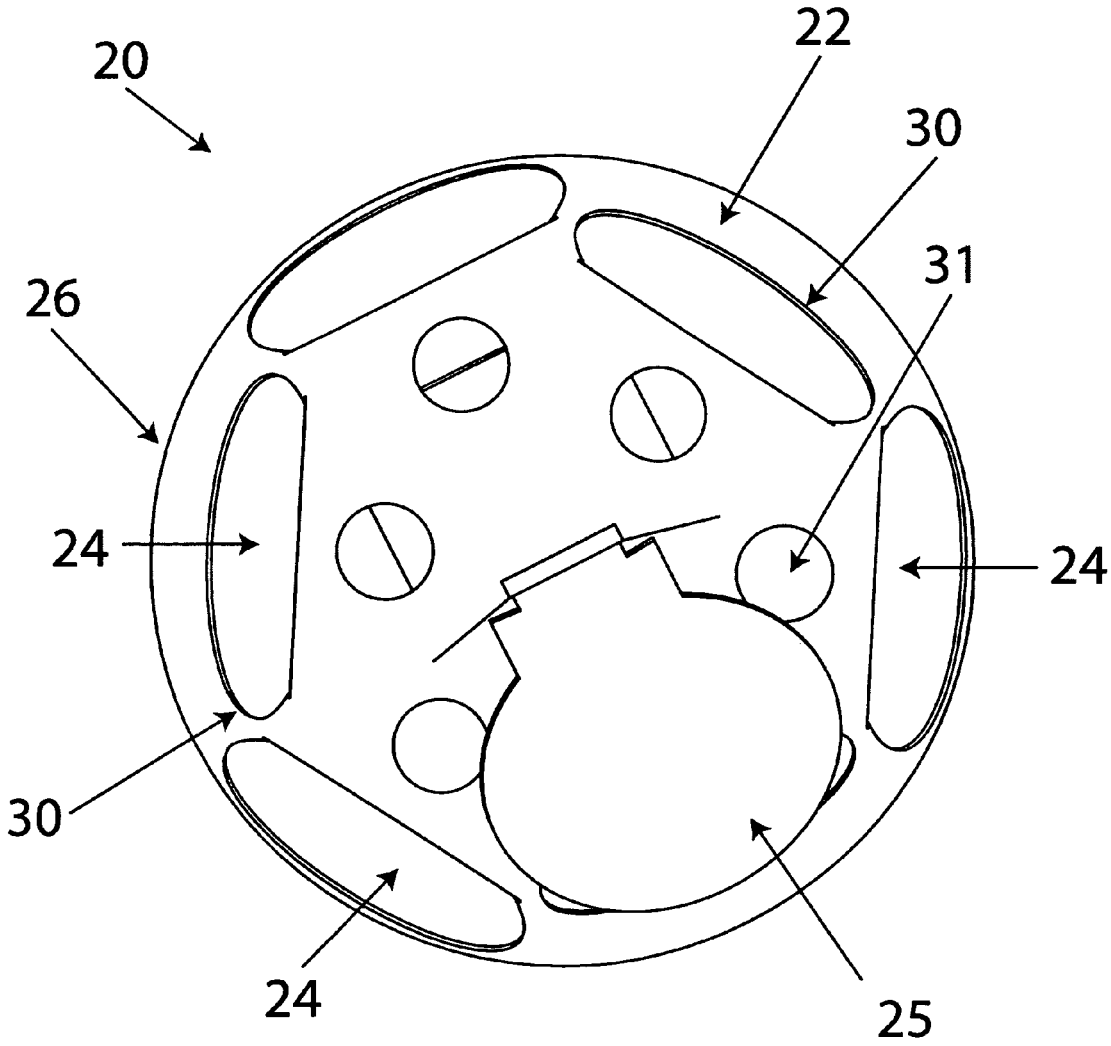
FIG. 3 is a top plan view of the advertising/promotional display product of FIG. 2 depicted in its collapse, two-dimensional configuration.
Figure 4:
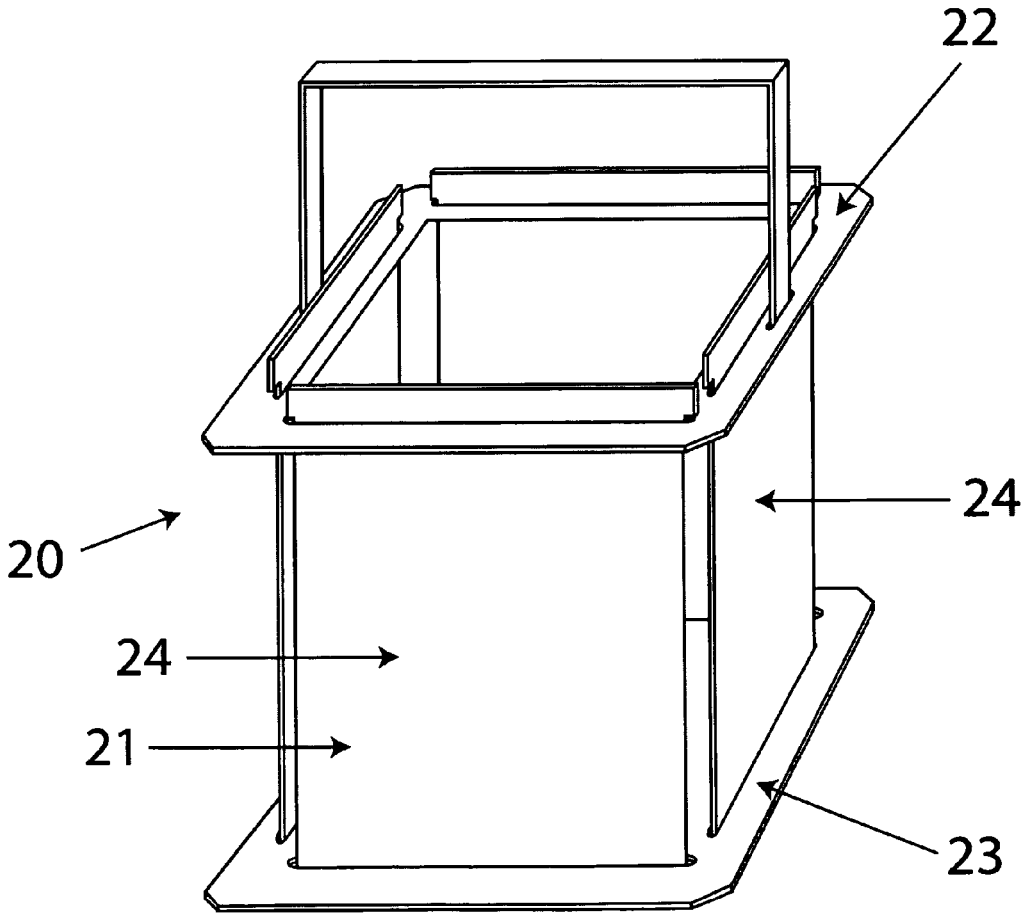
FIG. 4 is a perspective view of an alternate embodiment of the advertising/promotional display product of the present invention shown in its fully erect, three-dimensional configuration.
Figure 5:
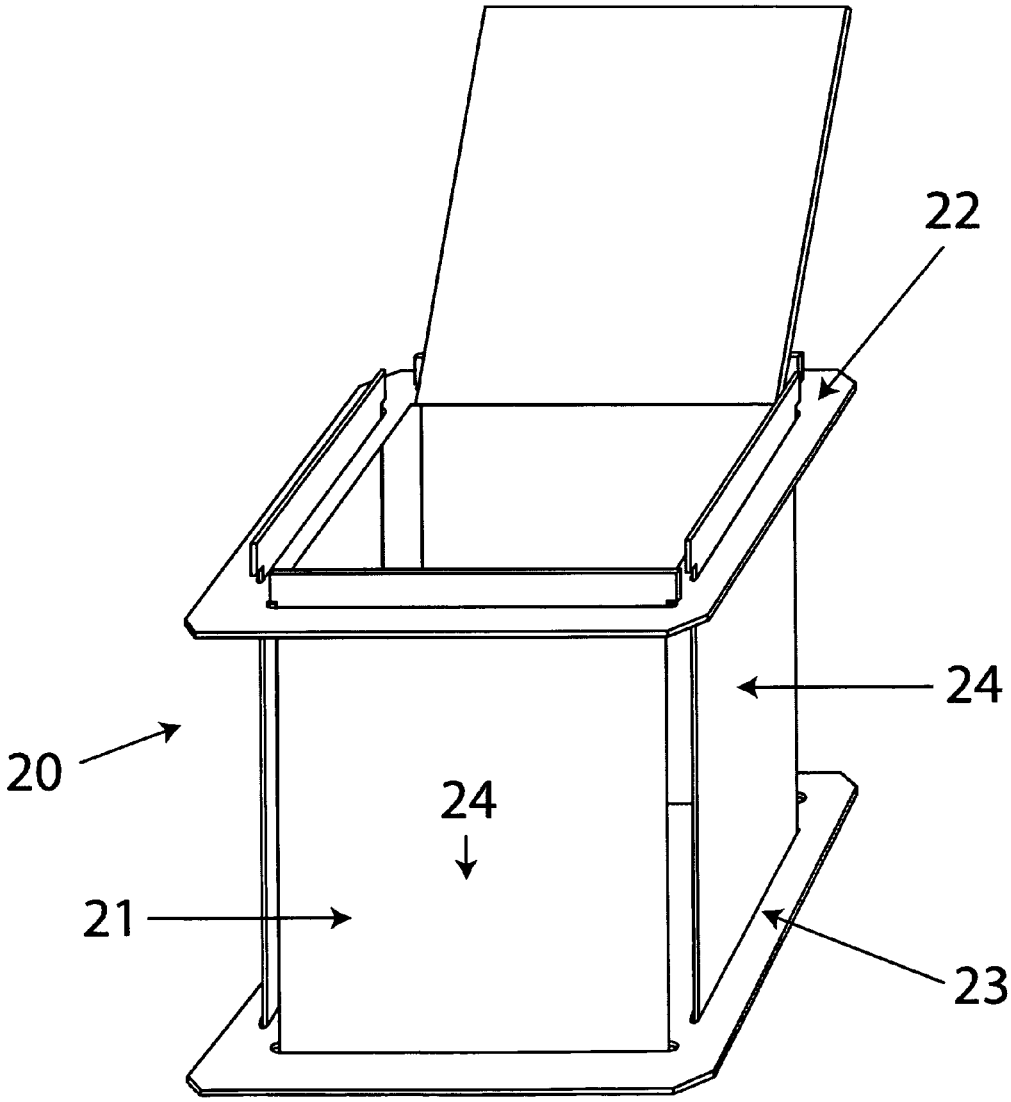
FIG. 5 is a perspective view of the advertising/promotional display product of FIG. 4 shown with a pivotable top cover in the open position.

In FIGS. 1-3, a first preferred embodiment of the present invention is depicted. In this embodiment, advertising/promotional display product 20 is constructed as a multi-panel housing member 21 which is constructed as a combined calendar and pencil holder. In the preferred construction of this embodiment of the present invention, multi-panel housing member 21 comprises holding plate 22, movable plate 23, and a plurality of panel members 24. By employing these few, principal components which are constructed in the manner detailed herein, a unique, visually exciting and interested generating advertising/promotional display product is achieved. Furthermore, using these principal components, a wide variety of alternate forms and configurations can be constructed and employed for numerous alternate purposes.

In the embodiment depicted in FIGS. 1-3, advertising/promotional display product 20 comprises six separate and independent panel members 24, each of which are printed with desired indicia thereon. As depicted, in this embodiment, the indicia comprises the months of one year, along with the days and dates of each month. As a result, this embodiment of display product 20 is able to function as a tabletop calendar display for one particular year. In addition, additional decorative indicia may be printed on panels 24, along with any desired advertisement, logo, and/or promotional information printed on either panels 24 or additional, upstanding display panel or holder 25.

In the preferred construction of this embodiment of the present invention, holding plate 22 incorporates an outer, terminating edge 26 with a plurality of slots or apertures 30 formed in holding plate 22. Furthermore, each slot/aperture 30 is preferably constructed for receiving and lockingly engaging one panel member 24 therein. In this way, each panel member 24 is positioned in a slot/aperture 30 of holding plate 22 in a manner which enables each panel member 24 to be arcuately pivotable relative to holding plate 22 while also being securely mounted to holding plate 22 to prevent longitudinal or sliding movement of panel member 24 relative to holding plate 22.

In addition, holding plate 22 is preferably constructed with slots/apertures 30 formed in a substantially circular array spaced inwardly from terminating edge 26 thereof. In this way, once panel members 24 are mounted in slot/apertures 30, panel members 24 are positioned directly adjacent outer terminating edge 26 of holding plate 22.

Furthermore, in the preferred construction, holding plate 22 also incorporates a plurality of holes 31 formed therein which are positioned inwardly of slots/apertures 30. By incorporating holes 31 in holding plate 22, the desired pencil holding function for this embodiment of the present invention is easily achieved.

The preferred construction of this embodiment of advertising for promotional display product 20 is effectively completed by incorporating movable plate 23. In the preferred construction, movable plate 23 comprises a substantially circular shaped member having an outer, terminating edge 27. In addition, movable plate 23 incorporates a plurality of slots 33 formed therein and positioned in a substantially circular array, spaced inwardly from terminating edge 27. Each slot 33 is constructed for receiving one panel member 24 and enabling the panel member 24 to be longitudinally movable relative to slot 33.

By employing this construction, plate 24 is quickly and easily moved from a first position, wherein plate 24 is directly adjacent or in contact with plate 22, to a second position wherein plate 24 is extended or spaced away from plate 22 a distance substantially equal to the overall length of panel members 24.

In addition, in the preferred construction, each panel member 24 incorporates side edges 35 and 36 which define the overall length of each panel member 24. Furthermore, one or more panel members 24 also incorporates flange extension 37 formed at the bottom of side edge 35 and extending outwardly therefrom, and flange extensions 38 formed on opposed side edge 36, extending outwardly from bottom of side edge 36.

By employing this construction, flange extensions 37 and 38 provide a positive abutment stop for movable plate 23, controllably limiting the longitudinal movement of plate 23 along the length of panel members 24. In this way, whenever advertising/promotional display product 20 is to be moved from its first, substantially flat, two-dimensional configuration into its second, fully erect, three-dimensional configuration, movable plate 23 is advanced along the length of panel members 24, until movable plate 23 engages flange extensions 37 and 38 of plate numbers 24. Once in this second position, plate member 23 is incapable of being advanced any further, effectively establishing the desired fully erect, three-dimensional configuration, with plate number 23 forming the base of advertising/promotional display product 20, while also simultaneously causing panel members 24 to be positioned and lockingly held in their fully displayed position.

As is evident from the foregoing discussion, advertising/promotional display product 20 is capable of being quickly and easily moved between its two alternate configurations, enabling the user to quickly and easily transform advertising/promotional display product 20 from its first two-dimensional, flat configuration into its second, three-dimensional, fully erect, display configuration. Furthermore, by merely advancing movable plate 23 along the length of panel members 24, the automatic transformation of advertising/promotional display product 20 into its fully erect three-dimensional configuration is achieved in a manner which directly involves the user, while also being rapid, quick, and easily achieved.

Furthermore, by constructing panel members 24 in a manner which securely maintains panel members 24 in locked engagement with holding plate 22, while panel members 24 are arcuately pivotable relative to holding plate 22, advertising/promotional display product 20 achieves a construction which allows panel members 24 to be easily folded relative to holding plate 22 and movable plate 23 whenever display product 20 is in its collapsed, two-dimensional configuration.

As a result, shipment ease and convenience is realized, while also providing an advertising/promotional display product which enables the sponsor to have a construction which provides interest and excitement to the user while also having numerous panel members or surfaces upon which any desired indicia, message, information, logo, alphanumeric designations, and the like can be printed for continuous viewing by the user. As a result, all of the goals and objectives sought by sponsors of advertising/promotional products are realized in a construction which is manufactured and assembled in an efficient and cost effective manner.

In FIGS. 4, 5 and 7-13 further alternate constructions of advertising/promotional display product 20 of the present invention are depicted. In each of these embodiments, advertising/promotional display product 20 comprises housing member 21 which is formed by holding plate 22, movable plate 23, and a plurality of panel members 24.

Furthermore, in each embodiment, the construction and arrangement of these components is substantially identical to the construction and arrangement detailed above in reference to FIGS. 1-3. However, in these alternate embodiments, the number of panel members and/or the number of movable plates varies, thereby providing advertising/promotional display products 20 which vary from triangular shapes, having the three panel members 24 to multi-sided, multi-paneled constructions having varying configurations. As is evident from a review of these alternate constructions, as well as the discussions provided above, advertising/promotional display product 20 of the present invention can be manufactured with virtually any number of panel members desired, as well as with any desired size and overall shape.

Figure 13:
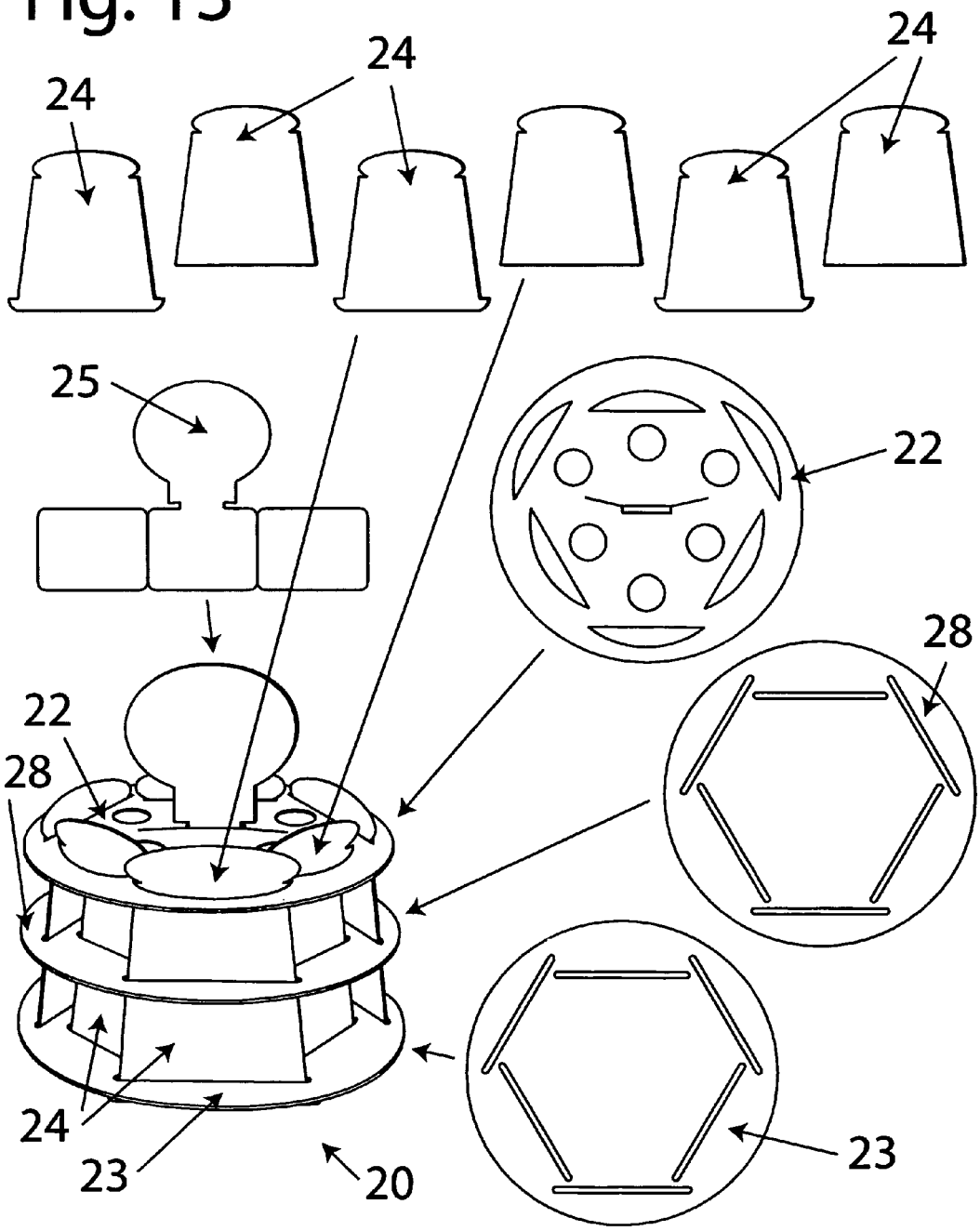

Furthermore, a shown in FIG. 13, three plate members can be employed with two of the plate members being movable. In this way, added strength and rigidity are provided. If desired, further additional plate members can be used with equal efficacy.

In addition, in the embodiments provided, alternate panel member configurations are also depicted, with panel members varying in construction from substantially flat panels, folded panels, and curved panels. Although these configurations are preferred, virtually any other desired alternate construction can be implemented with equal efficacy. In addition, alternate shapes, apertures, and other configurations can be employed in panel members 24 without departing from the scope of this invention.

Figure 6:
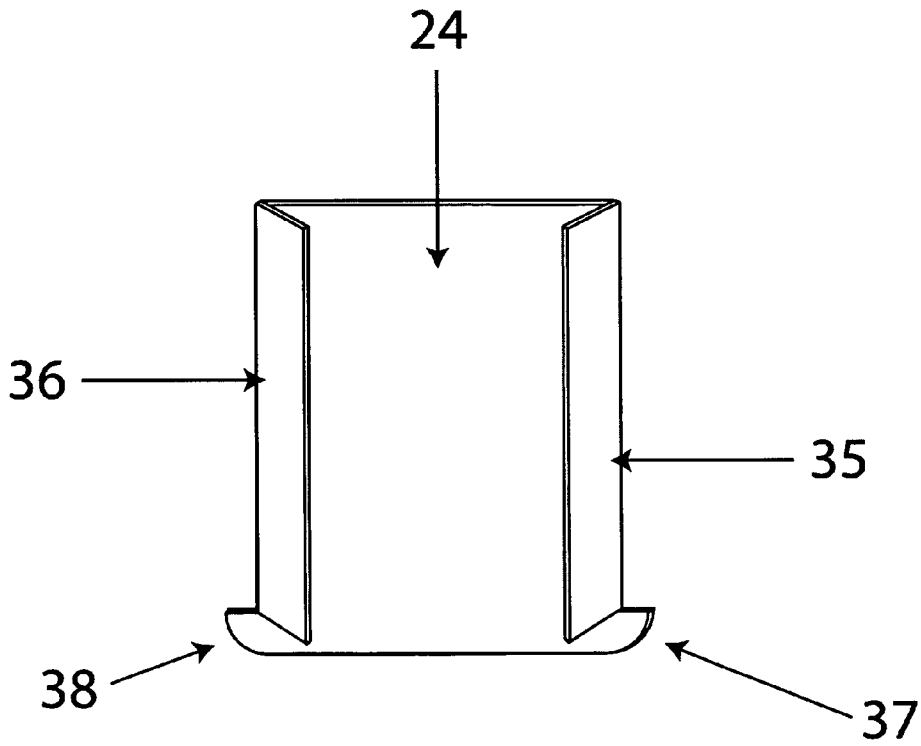
FIG. 6 is a front elevation view of one panel construction employed in the advertising/promotional display product of FIG. 4.
Figure 7:
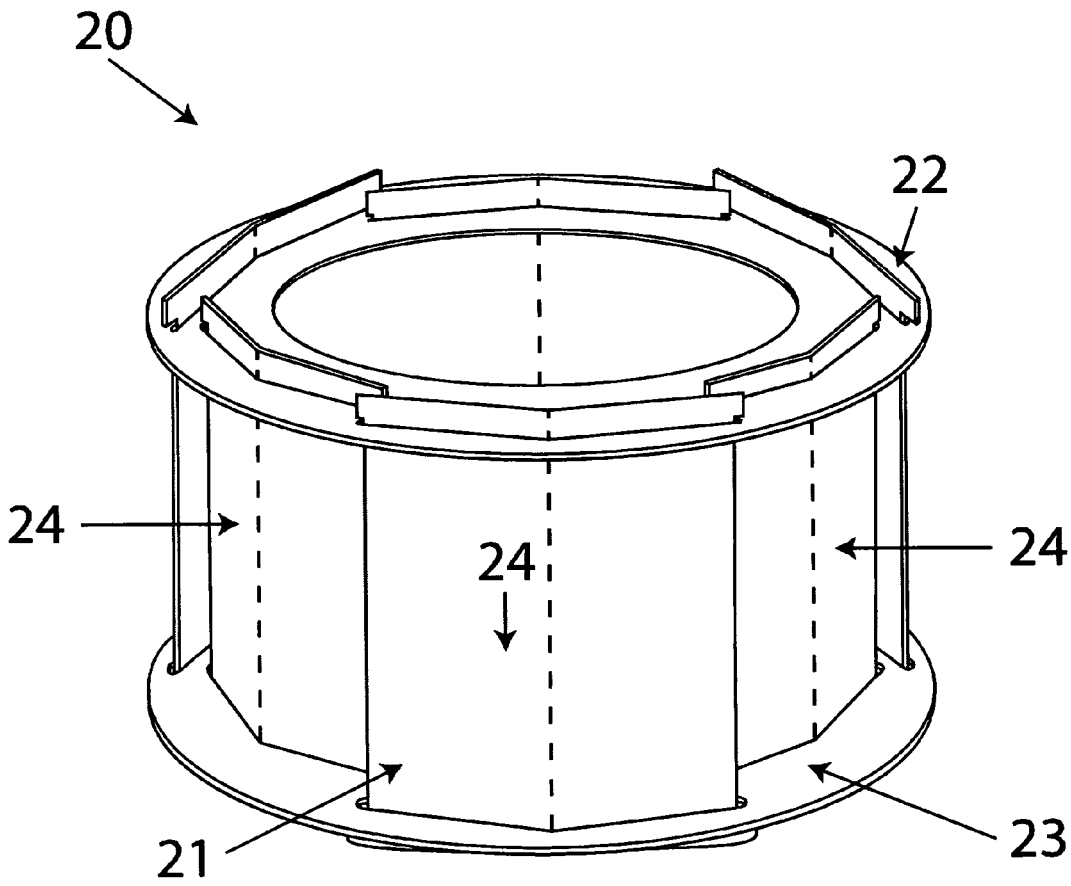
FIGS. 7-13 are perspective views of alternate embodiments of the multi-sided advertising/promotional display product of the present invention.
Figure 8:
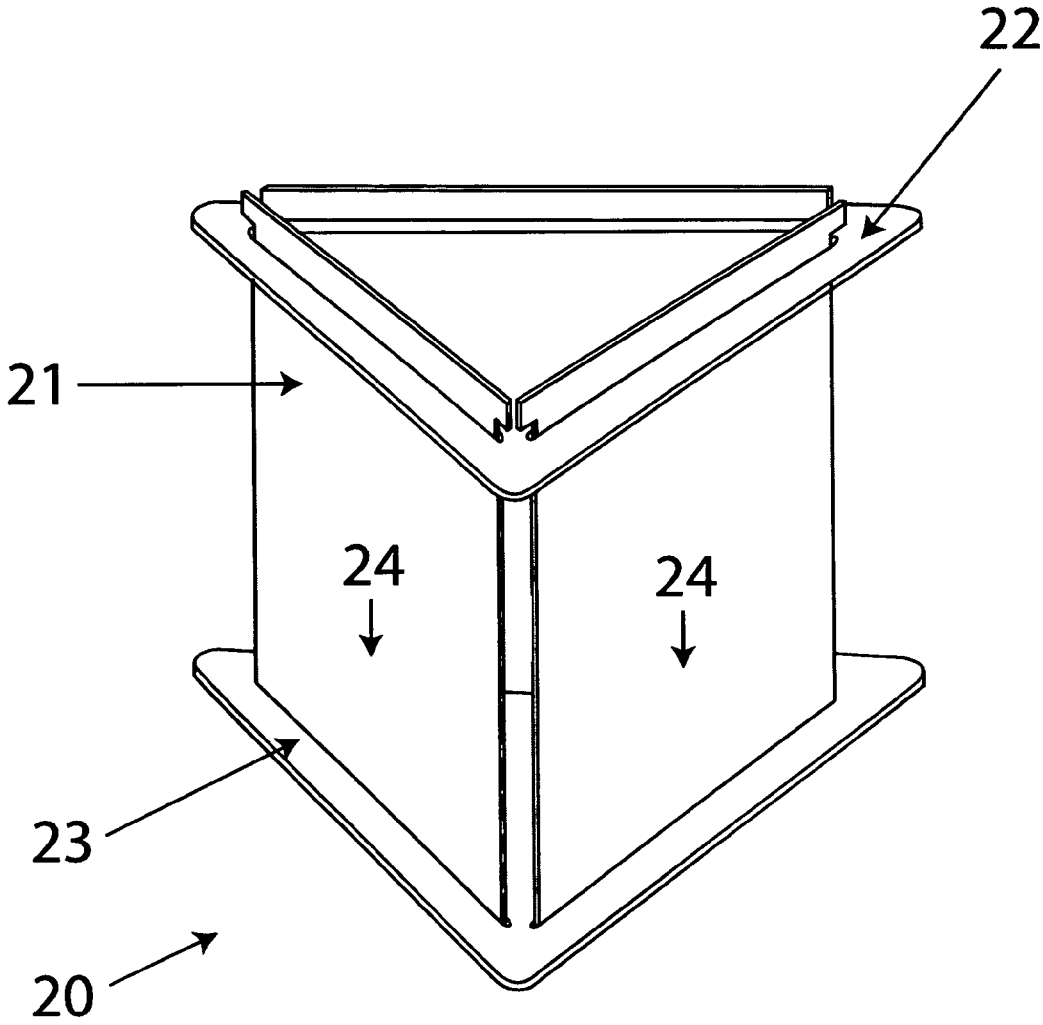
Figure 9:
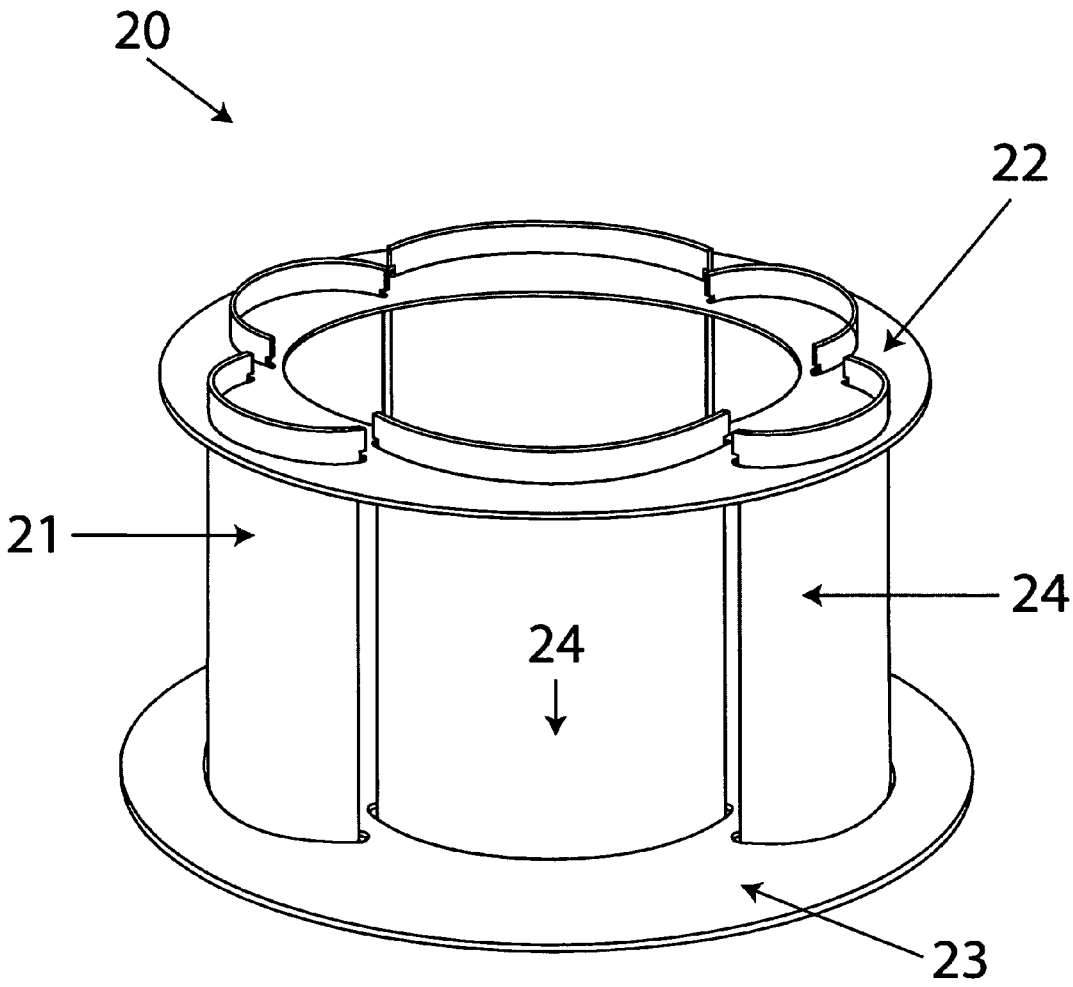
Figure 10:
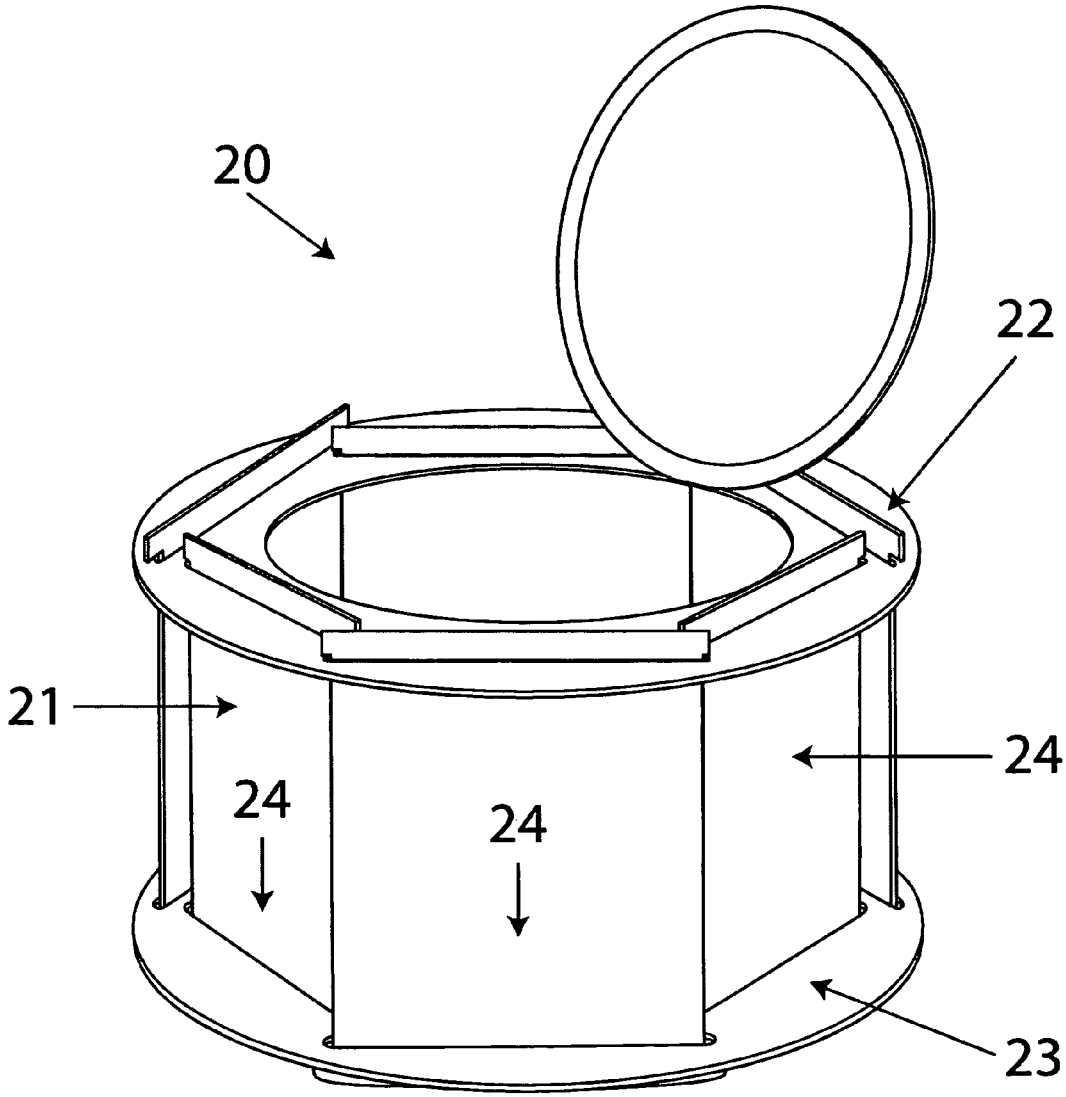
Figure 11:
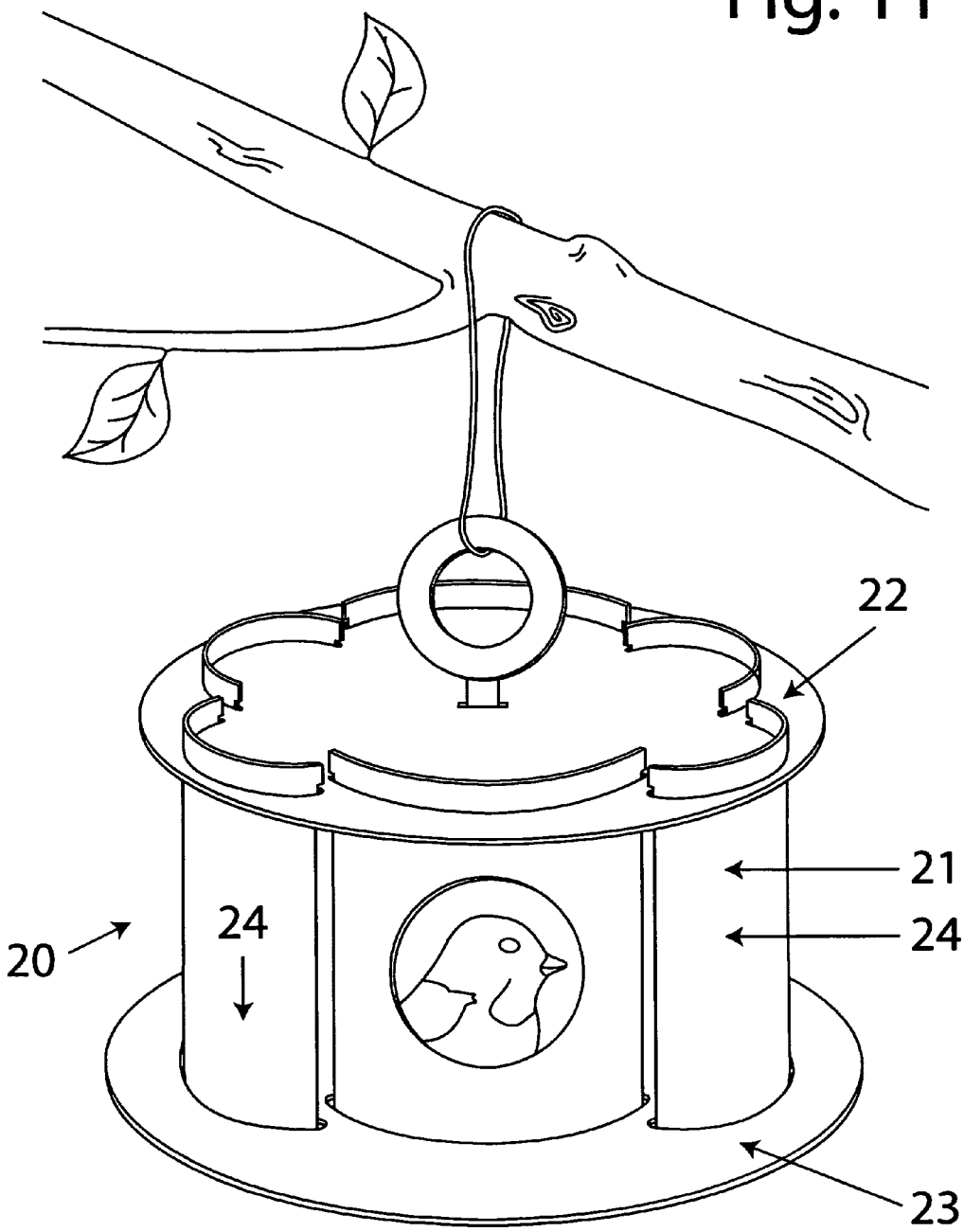
Figure 12:
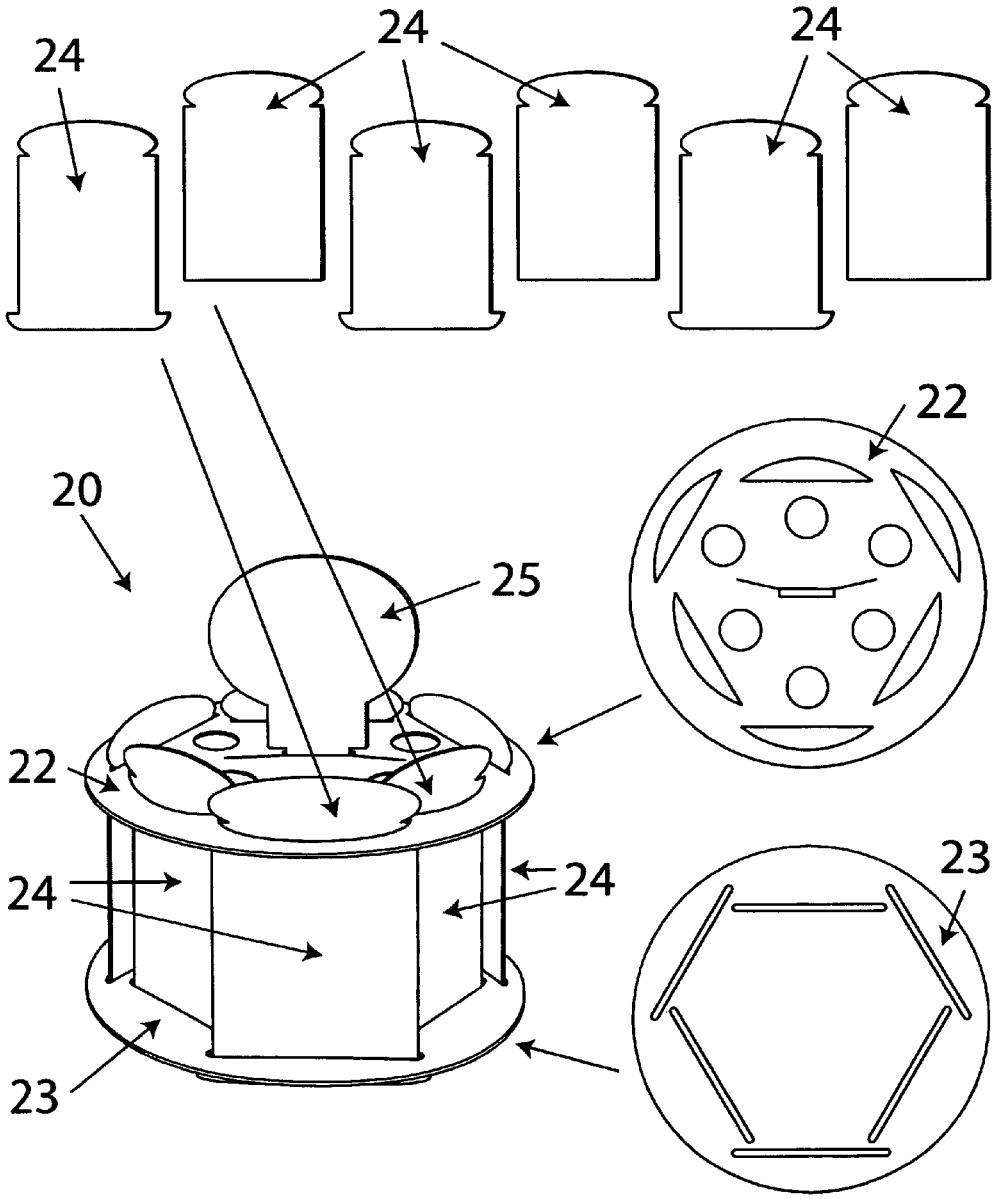

Finally, FIG. 6 depicts a typical construction for panel 24 wherein panel member 24 comprises a substantially flat construction incorporating flange extensions 37 and 38 formed at the bottom of side edges 35 and 36, along with a folded tab or flap extending from the length of side edges 35 and 36. This Figure is provided to clearly and unequivocally depict flaps or tabs incorporated into panel members 24. By employing this embodiment, tabs or flaps are extended whenever plate member 23 is fully extended, thereby adding rigidity to panels 24 and strength to the assembly. However, any alternate construction or configuration desired can be implemented without departing from the scope of this invention.

It will thus be seen that the objects set forth above, among those made apparent from the preceding description, are efficiently attained and, since certain changes may be made in the above article without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described our invention, what we claim is new in desire to secure by Letters Patent is:

1. An advertising/promotional display system comprising a housing movable between a first, collapsed, substantially flat, two-dimensional position and a second, fully erect, three-dimensional position, said housing comprising:

A. a first plate or collar member incorporating an outer, peripheral edge and a first plurality of slots formed in said first plate/collar member spaced inwardly from the outer edge and positioned in cooperating association with each other;

B. a second plate or collar member incorporating an outer, peripheral edge and a second plurality of slots or apertures formed in said second plate/collar member spaced inwardly from the outer edge and positioned in cooperating association with each other; and C. a plurality of separate and independent panel members, each of said panel members a) comprising a top edge, a bottom edge, a first side edge, and a second side edge, b) being dimensioned for cooperating engagement in one of said first plurality of slots and one of said second plurality of slots, c) incorporating a first abutment stop formed along the first side edge and the second side edge of the panel adjacent the bottom edge thereof, and d) incorporating a second abutment stop formed along the first side edge and the second side edge of the panel adjacent the top edge thereof, thereby enabling the first plate/collar member and the second plate/collar member to be independently longitudinally movable along the side edges of the panel members between the first abutment stops and second abutment stops thereof.

2. The advertising/promotional display system defined in claim 1, wherein said second abutment stop of each panel member is further defined as being constructed for locking engagement in the first plurality of slots formed in said first plate/collar members thereby preventing the first plate/collar member from longitudinally moving along the length of said panel members.

3. The advertising/promotional display system defined in claim 2, wherein each of said panel members are arcuately pivotable relative to the first plate/collar member and the second plate/collar member whenever the first plate/collar member and the second plate/collar member are positioned in side to side contacting relationship with each other, thereby establishing the first, substantially flat, two-dimensional configuration of said housing.

4. The advertising/promotional display system defined in claim 3, wherein said second plate/collar member is longitudinally movable along the first side edge and second side edge of each panel member enabling said panel members to be arcuately pivoted from a first folded configuration into the second fully erect, three-dimensional configuration with each of said panel members being substantially perpendicular to the first and second plate/collar members, thereby establishing the second, fully erect configuration of said housing.

5. The advertising/promotional display system defined in claim 4, wherein the first plurality of slots formed in said first plate/collar member are further defined as being positioned in juxtaposed, spaced, cooperating relationship effectively forming a substantially circular array, and said second plurality of slots formed in said a second plate/collar member are further defined as being positioned and juxtaposed, spaced, cooperating relationship effectively forming a substantially circular array.

6. The advertising/promotional display system defined in claim 1, wherein each of said panel members is further defined as comprising indicia printed on an outer surface thereof, thereby providing a desired visual communication to the user.

7. The advertising/promotional display system defined in claim 6, wherein said indicia is further defined as comprising one or more selected from the group consisting of colors, figures, alphanumeric designations, designs, symbols, logos, characters, cavities, and apertures.

8. The advertising/promotional display system defined in claim 1, wherein each of said separate and independent panel members is further defined as comprising one selected from the group consisting of flat panels, curved panels, and angularly shaped panels.

9. The advertising/promotional display system defined in claim 1, wherein said housing is further defined as comprising between about 3 and 12 panel members, with each of said panel member is being maintained in juxtaposed, spaced, side to side relationship, effectively forming a substantially closed housing when in the second, fully erect position.

10. The advertising/promotional display system defined in claim 1, wherein said housing is further defined as comprising a third plate or collar member longitudinally movable along the length of said panel members, thereby establishing a reinforcing or rigidifying housing structure.

11. The advertising/promotional display system defined in claim 1, wherein said first plate or collar member is further defined as incorporating cut out zones formed therein for enabling products or elements to be inserted through said cut out zones and supported in the housing when said housing is in its fully erect configuration.

12. The advertising/promotional display system defined in claim 1, wherein said panel members further comprise a longitudinally extending folded section formed along the first side edge and the second side edge thereof, thereby establishing a panel member having inherent structural reinforcement.

13. The advertising/promotional display system defined in claim 1, wherein the first plurality of slots formed in said first plate/collar member are further defined as being positioned in a juxtaposed, spaced, staggered relationship to each other effectively forming an irregular panel array, and said second plurality of slots formed in said a second plate/collar member are further defined as being positioned in juxtaposed, spaced, staggered relationship to each other effectively forming an irregular panel array when said housing is in its second, fully erect configuration.

14. The advertising/promotional display system defined in claim 1, wherein said first plate/collar member is further defined as being cooperatively associated with the top edge of the panel members, thereby forming the upper surface of said housing.

15. The advertising/promotional display system defined in claim 14, wherein said second plate/collar member is further defined as being cooperatively associated with the bottom edge of the panel members when said panel members are in their fully erect position, with the second plate/collar member forming the lower surface of said housing.

16. The advertising/promotional display system defined in claim 15, wherein said housing is further defined as being quickly and easily movable between its first, substantially flat, two-dimensional configuration into its second, erect, three-dimensional configuration by merely longitudinally advancing the second plate/collar member downwardly along the side edges of the panel members for causing said panel members to arcuately pivoted away from the first plate/collar member, with said fully erect position being achieved when said second plate/collar member has been advanced into engagement with the abutment stops formed adjacent the bottom edge of the panel members.

17. The advertising/promotional display system defined in claim 16, wherein said housing further comprises a separate and independent handle member mounted to the first plate/collar member and extending upwardly from said first plate/collar member for enabling said housing to be easily moved by the user when it its second, fully erect configuration.

* * * * *